United States Patent [19]

Ohya et al.

[11] Patent Number: 5,039,601

[45] Date of Patent: Aug. 13, 1991

[54] SILVER HALIDE EMULSIONS WITH SILVER HALIDE GRAIN GROUPS OF DIFFERENT DESENSITIZING AGENT CONTENT

[75] Inventors: Yukio Ohya, Hino; Syoji Matsuzaka, Hachioji; Hirofumi Ohtani, Hachioji; Yoshiro Ito, Hachioji; Mineko Ito, Tokyo, all of Japan

[73] Assignee: Konica Corporation, Tokyo, Japan

[21] Appl. No.: 579,255

[22] Filed: Sep. 5, 1990

[30] Foreign Application Priority Data

Aug. 21, 1987 [JP] Japan ..... 62-208523

[51] Int. Cl.[5] ..... G03C 1/36

[52] U.S. Cl. ..... 430/569; 430/606

[58] Field of Search ..... 430/569, 606

Related U.S. Application Data

[63] Continuation of Ser. No. 501,972, Mar. 30, 1990, abandoned, which is a continuation of Ser. No. 234,120, Aug. 19, 1988, abandoned.

[56] References Cited

U.S. PATENT DOCUMENTS 3,888,676 6/1975 Evans ..... 430/571
4,301,242 11/1981 Patzold et al. ..... 430/569
4,818,659 4/1989 Takahashi et al. ..... 430/264

FOREIGN PATENT DOCUMENTS 0087880 9/1983 European Pat. Off. .
0269056 6/1988 European Pat. Off. ..... 430/606
2382028 9/1978 France .

OTHER PUBLICATIONS

Patent Abstracts of Japan, vol. 10, No. 89 (p-444) (2146), Apr. 8, 1986.
Journal Fur Signalaufzeichnungsmaterialien, M. T. Beck et al., vol. 2, No. 1, pp. 25-31, 1974.

*Primary Examiner*—Charles L. Bowers, Jr.
*Assistant Examiner*—Janet C. Baxter
*Attorney, Agent, or Firm*—Finnegan, Henderson, Farabow, Garrett and Dunner

[57] ABSTRACT

A silver halide color negative photographic light-sensitive material is disclosed which is improved on stability to fluctuation of processing conditions applied thereon, and has a sufficient wide exposure latitude. The photographic material is also improved on standing stability of silver halide emulsion in the course of manufacturing thereof. The photographic material comprises a support having thereon photographic component layers including at least one silver halide emulsion layer containing at least two groups of silver halide grains each being substantially different in desensitizing agent content from each other.

9 Claims, No Drawings

SILVER HALIDE EMULSIONS WITH SILVER HALIDE GRAIN GROUPS OF DIFFERENT DESENSITIZING AGENT CONTENT

This application is a continuation of U.S. application Ser. No. 07/501,972, filed Mar. 30, 1990, now abandoned. which is a continuation, of U.S. application Ser. No. 07/234,120, filed Aug. 19, 1988, now abandoned.

FIELD OF THE INVENTION

The present invention relates to a negative-type silver halide color photographic light-sensitive material for full-color photographing, and, in particular, to a negative-type silver halide color photographic light-sensitive material comprising negative-type silver halide grains containing a desensitizing agent.

BACKGROUND OF THE INVENTION

In the current color photographic process, the most commonly practiced system is the so-called negative-positive system wherein a subject is photographed with a color negative film, and the enlarged image is printed onto a color paper to produce a color print. One outstanding reason for such popularity of this system is that color negative films have a very wide range of latitude of exposure levels, and this very seldom results in failure in image-taking during photographing with a camera; this means an ordinary one who is a layman lacking in expertise in photography can readily enjoy color photography. This advantage is an outstanding feature of the negative-positive system, and is not readily available with a reversal film or the like; it is important that a color negative film have a wide range of an exposure latitude.

The color negative films for photographing with a camera, and that are commercially available, contains, in combination, in order to achieve a wide range of an exposure latitude, in each of the negative film, each of the blue-, green- and red-sensitive layers independently takes a multilayer constitution comprising both a high-sensitivity emulsion layer containing larger size silver halide grains and a low-sensitivity emulsion layer containing smaller size silver halide grains.

However, a silver halide photographic light-sensitive material containing different groups of silver halide grains, where the groups have grains sizes significantly different with each other, incurs various problems.

First, such a material is less stable to the variation of processing condition.

In contrast to color reversal films, the color negative films are developed in various photofinishing laboratories, more possibly in various processing conditions. Therefore, the higher processing stability relative to change in processing conditions is required of the color negative films.

Second, standing stability of coating emulsions of such a type of film is inferior.

Third, due to differences in influence of an inhibitor diffused from another layer, it is difficult to endow each color with gradation of good tone reproduction.

There is another technique available for improving a stability with respect to variation of processing condition, wherein emulsions independently contains silver halide grains comprising substantially identical average size subjected to chemical sensitization, whereby to each of the divided emulsions is added a sensitizing dye in a varying molar ratio, and then the separated emulsions are blended together (Japanese Patent Publication Open to Public Inspection - hereinafter referred to as Japanese Patent O.P.I. Publication - No. 244944/1985, and the like). This re-united type emulsion, however, in the course of a standing period preceding a coating operation, undesirably develops adsorption equilibration of dye among grains.

SUMMARY OF THE INVENTION

The objects of the invention are as follows: (1) to provide a silver halide color negative photographic light-sensitive material (hereinafter referred to as a photosensitive material) that is capable of exhibiting stable Photographic performance even under a variable processing condition; and has a sufficiently wide exposure latitude for a photosensitive material, and excellent gradation.

(2) to provide a photosensitive material, emulsions for which the coating emulsions excel in standing stability.

In investigating various methods of using a desensitizing agent, the inventors found that the above-mentioned objects of the invention are achieved by one of the silver halide color negative photographic light-sensitive materials mentioned below, as MATERIAL A, B or C.

MATERIAL A:

A silver halide color negative photographic light-sensitive material comprising a support having thereon photographic component layers including at least one silver halide emulsion layer containing at least two groups of silver halide grains being substantially different in desensitizing agent content (mol/mol silver halide) from each other.

Additionally, 'substantially different in desensitizing agent content' means that a ratio of a content to another content is 5 or more. Preferable ratio is 10 or more.

MATERIAL B:

A silver halide color negative photographic light-sensitive material comprising a support having thereon photographic component layers including at least one silver halide emulsion layer containing at least two groups of silver halide grains substantially different in speed from each other, wherein at least one of said groups of silver halide grains other than the group of silver halide grains having the highest speed, contains a desensitizing agent.

Additionally, 'substantially different in speed' means that the difference between logarithmic values (logH) of exposure (lux $\times$hour $=$H) that provide (fog $+0.1$) densities is not less than 0.1.

According to MATERIAL B, the difference in sensitivity of a silver halide grain group of a highest speed and that of a lowest speed silver halide grain group is, in the logarithmic expression defined above, preferably not less than 0.25, more particularly, not less than 0.5.

MATERIAL C:

A silver halide negative photographic light-sensitive material comprising a support having thereon photographic component layers including at least one silver halide emulsion layer containing silver halide grains, wherein an average desensitizing agent content of grains of Group A consisting of grains of 5% by weight portion of silver halide grains having higher desensitizing agent content than the residual 95% by weight portion of silver halide grains, contained in the silver halide emulsion layer, is not less than 10 times higher than that of grains of Group B consisting of grains of 5% by weight portion of silver halide grains having lower desensitizing agent content than the residual 95% by weight portion of silver halide grains, contains in the silver halide emulsion layer.

Preferably, said times is not less than $10^3$ times.

The 'exposure latitude', important consideration in the photosensitive material, relates to a range of exposures that shows significant differences in exposure effect and specifically relates to an exposure area ranging from the highest light area to the deep shadow area on the photographic characteristic curve.

The exposure latitude is determined by a method defined in Photographic Chemistry, pp. 393 (Shashin Kogyo Shuppan-sha. 1982).

That is, the coordinate system where the horizontal axis represents logH and the vertical axis represents transmittance density is used, whereby two points respectively in foot and shoulder areas of a characteristic curve and designated, and at these points, the tangential gradients are respectively 0.2. Then the exposure latitude is defined as the difference in logH of these points.

The preferred photosensitive material according to the invention are those having an exposure latitude of 3.0 to 8.0 as determined by the above-mentioned method.

Additionally, such a characteristic curve can be obtained as intended, by selectively combining a plurality of silver halide grains groups or portions each having different sensitivity distribution, and density effect.

According to the invention, a certain portion of silver halide grains contains a desensitizing agent. However, the invention does not exclude the case that all silver halide grains contain a desensitizing agent.

Additionally, according to MATERIAL A or B, preferably the desensitizing agent content of the group of silver halide grains having the lowest desensitizing agent content is zero, and according to MATERIAL C, preferably the desensitizing agent content of grains of Group B is zero.

According to MATERIAL A or B, preferably desensitizing agent content of the group of silver halide grains having highest desensitizing agent content is not less than 10 (more preferably $10^3$) times higher than that of the group of silver halide grains having the lowest desensitizing content.

According to MATERIAL A or B, the difference between speeds of the group of silver halide grains having highest desensitizing agent content and the same grains except that any desensitizing agent is not contained, is preferably not less than 0.3, more preferably not less than 0.5. and according to MATERIAL C, the difference between speeds of grains of Group A and the same grains as grains of Group A except that any desensitizing agent, is preferably not less than 0.3, more preferably not less than 0.5, in the logarithmic expression defined above.

The photosensitive material of the invention contains a plurality of silver halide grain groups or portions having a common color sensitivity. The average grain size of the respective silver halide groups or portions may be either different of identical. The grain size ratio ($\bar{r}_2/\bar{r}_1$) between an average grain size ($\bar{r}_2$) of a silver halide grain group of a smallest average grain size in MATERIAL A or B and of GRAINS A in MATERIAL C and that ($\bar{r}_1$) of a largest average grain size in MATERIAL A or B and grains of Group B in MATERIAL C is 0.5 to 1, preferably, 0.7 to 1, in particular, 0.8 to 1; the most favorable ratio is 0.9 to 1. The grain size distribution of the whole of silver halide grains in one specific color sensitive layer, in terms of the variation coefficient that is the ratio $S/\bar{r}$ between the standard deviation in grain size S defined below and the average grain size ($\bar{r}$) defined below, is preferably not more than 0.4, in particular, not more than 0.33, more particularly, not more than 0.25; the most favorable ratio is not more than 0.20.

$$S = \sqrt{\frac{\Sigma (\bar{r} - ri)^2 ni}{\Sigma ni}}$$

The average grain size ($\bar{r}$) is defined by the expression below:

$$\bar{r} = \frac{\Sigma ni ri}{\Sigma ni}$$

where ri represents a grain size (in the case of cubic silver halide grains, the length of one edge; in the case of grains other than cubic, the length of one edge on an imaginary cube that has a volume same as that of the non cubic grain); and ni represents the number of grains of size ri.

The relation of grain size distribution can be determined by a method described in the papers of Triboulet and Smith, 'Emprical Correlation between Sensitometric Distribution and Grain Size Distribution in Photography', the Photographic Journal LXXIX (1949), pp. 330–338.

According to the invention, using a desensitizing agent can attain a wide exposure latitude even if the difference in average grain sizes of the grain groups or portions is smaller, and a variation coefficient of grains as a whole can be made smaller.

Accordingly, the groups or portions of silver halide (denoted as AgX) grains having a smaller variation coefficient, which are contained in a common emulsion layer and are subjected to common environments, are desirably stabilized for storage and variation of processing conditions. Additionally, from the viewpoint of manufacturing technique, under identical chemical sensitization conditions, each of the AgX grain groups or portions is endowed with enhanced sensitivity, and the respective groups or portions at the same time reach chemical equilibration, thereby a mixture system of the respective AgX grain groups or portions can be chemically sensitized in a single batch.

The possible desensitizing agents used in the invention are arbitrarily selected from various agents such as metal ions, antifoggants, stabilizers and desensitizing dyes; however, for desensitizing, a method of metal ion doping is preferable.

The examples of metal ions used for the doping are metal ions such as of Cd, Zn, Pb, Fe, Tl, Rh, Bi, Ir, Au, Os, and Pd. These types of metal ions are preferably used, for example, in the form of a halogen complex salt; the preferred pH level in the AgX suspension system in the course of doping is not higher than 5.

The preferred amount of metal ions used for doping varies depending upon the type of metal ions, size of silver halide grains, position of doping with metal ions, and intended sensitivity. However the preferred amount is $10^{-17}$ to $10^{-2}$, or, in particular, $10^{-16}$ to $10^{-4}$ mol per mol AgX. If such metal ions are rhodium ions, the preferred amount is $10^{-14}$ to $10^{-2}$ mol, in particular, $10^{-11}$ to $10^{-4}$ mol per mol AgX.

By selecting, per Ag grain group, a kind of doping metal, and a position an amount of metal ions used for doping, each AgX grain group or portion is endowed with different sensitivity potential.

An amount of metal ions used for doping not more than $10^{-2}$ mol/AgX mol does not significantly affect the growth of silver halide grains. Accordingly, it is possible under identical conditions for growing grains, to prepare AgX groups or portions exhibiting a narrow size distribution.

Each of the respective AgX grain groups or portions respectively, which have undergone doping under different conditions can be subjected to treatment that allows these groups or portions to be industrially applicable, thereby these groups or portions are mixed together at a specific mixing ratio into the same batch, that is chemically sensitized. The respective AgX groups or portions are sensitized depending on their unique sensitivity potential, whereby a resultant emulsion is endowed with intented latitude based on the sensitivities of the grain groups or portions and on a mixing ratio between the groups or portions.

According to the invention, in addition to the use of the previously mentioned metal ion doping technique, a compound known in the art as an antifoggant, stabilizer or desensitizing dye may be used in order to prepare, whereby the AgX grain groups or portions of different sensitivity potentials. Such AgX grain groups or portions are mixed at a specific mixing ratio in compliance with the intended exposure latitude.

The examples of antifoggant or stabilizer each mentioned above are as follows:

Azoles, for example, benzothiazolium salts, indazoles, triazoles, benzotriazoles, and benzimidazoles;

Heterocyclic mercapto compounds, for example, mercaptotetrazoles, mercaptothiazoles, mercaptothiadiazoles, mercaptobenzothiasoles, mercaptobenzimidazoles, and mercaptopyrimidines;

Azaindenes, for example, tetraazaindenes, and pentaazaindenes;

Decomposition products of nucleic acids, for example, adenine, and quanine; benzenethiosulfonic acids; and thioketo compounds.

The examples of desensitizing dyes include a cyanine dye, merocyanine dye, complex cyanine dye, complex merocyanine dye, holopolarcyanine dye, hemicyanine dye, styryl dye, and hemioxonol dye.

From the viewpoints of shelf-life of the photosensitive material, standing stability of the coating emulsions, and other considerations, the preferred position of the desensitizing agent is inside individual silver halide grains; the distribution of such an agent can be either uniform, or such an agent can be localized either in the central or intermediate area of individual grains, or otherwise distributed decreasingly from the center to outer area of individual grains.

The preferred methods for forming such grains are methods that grow seed grains. The preferred method using seed grains are a method where a plurality of seed grain groups or portions are individually grown under different amounts of desensitizing agent and mixed: and a method where a plurality of seed grain groups or portions respectively containing a different amount of desensitizing agent are individually grown and are mixed or mixedly grown.

From the viewpoint of production efficiency, such an agent is localized in the center area of individual grains; additionally, using a system where seed grains of a smaller variation coefficient allows the process of grain growing onwards in a single batch.

More specifically, several groups or portions of seed grains not containing or containing a desensitizer such as metal ions for doping whose amount being sufficient to define the sensitivity potentials that correspond with the respective speed ranges of the respective AgX grain groups or portions, thereby these groups or portions of seed grains are mixed together into a single batch of suspension system based on a mixing ratio that results in a smooth characteristic curve, and thereby in the suspension system is precipitated additional AgX onto the seed grains, and the respective AgX grain groups are allowed to grow in an identical velocity, whereby a blended emulsion comprising a plurality of AgX grain groups or portions, in which each group or portions has unique sensitivity potential, is chemically sensitized.

When forming the above-mentioned AgX grains, a crystallization controlling agent, according to Japanese Patent O.P.I. Publication No. 122935/1985, may be used to control crystal appearance of the grains.

According to the invention, preferably said photographic component layers include a blue-sensitive silver halide emulsion layer, a green sensitive silver halide emulsion layer and a red-sensitive silver halide emulsion layer and at least one of which is said silver halide emulsion layer comprising said group or portion of silver halide grains containing a desensitizing agent, more preferably, each of said blue-sensitive, and green-sensitive emulsion layers is said silver halide emulsion layer comprising said group or portion of silver halide grains containing said desensitizing agent, and most preferably, each of said blue-sensitive, green-sensitive and red-sensitive emulsion layers is said silver halide emulsion layer comprising said group or portion of silver halide grains containing said desensitizing agent.

According to the invention, from the viewpoints of image quality and stability of photographic performance against variation of processing condition, a preferred color-sensitive layer sensitive to a specific color is of a single-layer constituted one.

According to the invention, preferably said photographic component layers include no other silver halide emulsion layer which has the substantially same color sensitivity with at least one silver halide emulsion layers containing said group or portion of silver halide grains containing said desensitizing agent.

The especially preferred mode of the invention is that the blue-sensitive layer and the green-sensitive layer are individually formed as a single layer; the most favorable mode is that the blue-sensitive layer, green-sensitive layer, and red-sensitive layer are individually formed as a single layer.

In the case of a layer sensitive to the same colored light is of a single layered when compared to a conventional multilayer consitiution, the number of layers formed in a silver halide photographic light-sensitive material is smaller, thus the total layer thickness is smaller. As a result, product efficiency, image sharpness and graininess of the light-sensitive material are improved. The preferred dry total layer thickness is from 3 to 20 μm, in particular, from 5 to 15 μm.

According to the invention, a light-sensitive silver halide emulsion can contain silver halides used in an ordinary silver halide emulsion. Such silver halides are silver bromide, silver iodo-bromide, silver iodo-chloride, silver chloro-bromide, silver chloro-iodo-bromide, silver chloride and the like. However, an emulsion containing silver halide grains substantially consisting of silver bromide is preferably used from the viewpoint of sensitivity.

To prepare a light-sensitive silver halide emulsion, both halide ions and silver ions are simultaneously blended together, or, otherwise, into a solution having one such type of ions the other type of ions may be incorporated. In conformity to the critical growth rage of silver halide crystals, silver halide grains may be formed by combinedly adding halide ions and silver ions step by step into a mixing vessel while the pH and pAg in the vessel being controlled. By this method, monodispersed silver halide grains having a regular crystal configuration and substantially identical grain size can be obtained. The halogen composition of grains may be modified by means of the conversion method during an arbitrary step in the formation of AgX.

Additionally, by subjecting the grains to an adequate reducing atmosphere, the reduction-sensitization nucleus may be integrated into the interior and/or onto the surface of individual grains.

From or in the silver halide emulsion of the invention, unnecessary soluble salts may be either removed or left unremoved, after the silver halide halide grains have satisfactorily grown. Such salts can be removed in compliance with the methods described in Article II of Research Disclosure No. 17643.

With the light-sensitive silver halide grains, every grain may have a uniformly distributed silver halide composition, or, otherwise, every grain may be a core/-shell grain wherein the interior and surface of each grain have the silver halide compositions different to each other. The core/shell grains are preferably used for high sensitivity.

The light-sensitive silver halide grains may be grains where a latent image is principally formed on the surface of individual grains, or, otherwise, may be grains where latent image is principally formed within the interior of individual grains.

The light-sensitive silver halide grains may be allowed to have regular crystal configurations such as cube, octahedron, tetradecahedron or the like, or irregular crystal configurations such as spherical or tabular shape or the like.

The light-sensitive silver halide emulsion can be chemically sensitized by a conventional method. The sulfur sensitization method, selenium sensitization method, reducing sensitization method, noble metal sensitization method that uses a noble metal compound of gold or the like, and others, can be used singly or in combination.

The light-sensitive silver halide emulsion is spectrally sensitized to an intended spectral range by using a dye known as a sensitizing dye in the photographic art. The sensitizing dyes are used either singly or in combination of more than two. A supersensitizer that is a compound neither having a spectral sensitization action or virtually absorbing visual light, though being capable of enhancing the sensitization action of a sensitizing dye may be contained in the similar emulsion together with a sensitizing dye.

The examples of spectral sensitizing dyes include a cyanine dye, merocyanine dye, complex cyanine dye, complex merocyanine dye, holopolarcyanine dye, hemicyanine dye, steryl dye, and hemioxonol dye.

The particularly useful dyes are a cyanine dye, merocyanine dye, and complex merocyanine dye.

The silver halide emulsion may incorporate, during and at the termination of the chemical sensitization and/or standing period preceding a coating process, a compound known as an antifoggant or stabilizer for the purposes of prevention of fogging during a manufacturing process, storage or photographic processing, or of stabilization of photographic performance.

As a binder (or protective colloid) in the silver halide emulsion, gelatin is advantageous. However, those useful for this purpose include gelatin derivative, graft polymer of gelatin and another high-molecular material; other protein, sugar derivative, cellulose derivative; and hydrophilic colloid of synthetic hydrophilic high-molecular material such as homopolymer or copolymer.

The photographic component layers mentioned above include such as a silver halide emulsion layer a protective layer, an intermediate layer, a filter layer, an anti-halation layer, an anti-irradiation layer, an antistatic layer.

In the emulsion layers and other hydrophilic colloid layers of a photosensitive material one or more kinds of hardener can be incorporated which being capable of enhancing layer strength by crosslinking binder (or protective colloid) molecules.

The hardener may be added to the sensitive material in an amount such as to eliminate the necessity of adding the hardener to a processing solution. However, the hardener may be additionally incorporated into a processing solution.

The examples of useful hardener include aldehydes such as formaldehyde, glyoxal, and glutaraldehyde; N-methylol compounds such as dimethylol urea, and methyloldimethylhydantoin; dioxane derivatives such as 2,3-dihydroxydioxane; active vinyl compounds such as 1,3,5-triacryloyl-hexahydro-s-triazine, and 1,3-vinylsulfonyl-2-propanol; active halide compounds such as 2,4-dichloro-6-hydroxy-s-triazine; mucohalogen acids such as mucochloric acid, and mucophenoxychloric acid; and others. These hardeners are used singly or in combination.

The emulsion layers of the sensitive material and/or other hydrophilic colloid layers may incorporate a plasticizer in order to enhance flexibility. The preferred plasticizers are the compounds described in Article XIIA or Research Disclosure No. 17643.

The emulsion layers of the sensitive material other hydrophilic colloid layers may incorporate a dispersion (latex) of a water-insoluble or slightly-soluble synthetic polymer in order to improve the dimension stability, and other requirements.

When incorporating an emulsion according to the invention into a color sensitive material, an emulsion layer preferably incorporates a dye forming coupler that is capable of forming a dye upon the coupling reaction with an oxidation product of an aromatic primary amine developing agent, for example, p-phenylenediamine derivative, and aminophenol derivative. The dye forming coupler is usually selected so that it is capable of forming a dye that absorbs spectral light to which an emulsion layer containing the similar coupler is sensitive: The blue-sensitive emulsion layer contains a yellow coupler; the green-sensitive emulsion layer, a magenta coupler; and the red-sensitive emulsion layer, a cyan coupler. However, in accordance with a specific requirement, a coupler-emulsion layer combination other that those specified above may be used to constitute a silver halide color photographic light-sensitive material.

The group of dye-forming couples includes couplers for color correction such as colored couplers; and compounds that are capable of, when coupled with an oxidation product of a developing agent, releasing fragments useful in photographic process, wherein the examples of such fragments include a development accelerator, bleaching promotor, developer, silver halide-solvent, tone controlling agent, hardener, fogging agent, antifoggant, chemical sensitizer, spectral sensitizer, and desensitizer. Furthermore, the so-called DIR compounds capable of releasing a developing inhibitor upon coupling reaction or reduction-oxidation reaction with an oxidized product of a developing agent used.

The yellow couplers preferably used are known acylacetanilide series couplers. Among these couplers, those advantageous are benzoylacetanilide series and pyvaloylacetanilide series compounds.

The typical examples of useful yellow couplers are those described in, for example, U.S. Pat. No. 2,875,057, West German Patent No. 1,547,868, British Patent No. 1,425,020, Japanese Patent Examined Publication No. 10783/1976, and Japanese Patent O.P.I. Publication No. 95346/1983.

The useful magenta couplers are known 5-pyrazolone series couplers, pyrazolobenzimidazole series couplers, pyrazolotriazole series couplers, open-chain acylacetonitrile series couplers, indazolone series couplers and the like.

The typical examples of useful magenta couplers are those described in, for example, U.S. Pat. No. 3,891,445, West German Patent No. 1,810,464, West German OLS Patent No. 2,408,665, Japanese Patent Examined Publication No. 6031/1965, and Japanese Patent O.P.I. Publication No. 55122/1978.

The cyan couplers usually used are phenol series or naphthol series couplers. The typical examples of useful cyan couplers are those described in, for example, U.S. Pat. No. 3,893,044, and Japanese Patent O.P.I. Publication No. 98731/1983.

The hydrophobic compounds, such as a dye-forming coupler, DIR compound, image stabilizer, anti-color-fogging agent, ultraviolet absorbent, and fluorescent whitening agent, each being emulsified and dispersed in the silver halide emulsion, are so-dispersed by various methods such as solid dispersion method, latex dispersion method, and oil-in-water emulsification-dispersion method. These methods are arbitrarily selected in compliance with the chemical structure or the like of a hydrophobic compound such as a coupler.

An anti-color-fogging agent may be used in order to prevent an oxidation product of a developing agent or an electron transfer agent from being migrating between emulsion layers of the sensitive material; such migration results in color stain, loss in sharpness, and excessively obvious graininess.

The anti-color-fogging agent may be contained in an emulsion layer itself, or in an intermediate layer that is disposed between adjacent emulsion layers.

The sensitive material may incorporate an image stabilizer that prevents degradation of a dye image. The compounds useful for this purpose are those described in Article VII J of Research Disclosure No. 17643.

The hydrophilic colloid layers, such as a protective layer and an intermediate layer, of the sensitive material may contain an ultraviolet absorbent to prevent fogging caused by electric discharge resulting from electrification by friction, and to prevent image degradation caused by ultraviolet rays.

The sensitive material may incorporate formalin scavenger to prevent the formalin from degrading a magenta coupler and the like during storage of the material.

The silver halide emulsion layers and/or other hydrophilic colloid layers of the sensitive material may incorporate a compound that is capable of changing developability of the material, as typified by a developing accelerator and a retardant; and bleaching promotor. The preferred compounds used as a developing accelerator are described in Articles XXI B through D of Research Disclosure No. 17643; and those used as a developing retardant, in Article XXI E of Research Disclosure No. 17643. The sensitive material may incorporate a black-and-white developing agent and/or a precursor thereof, for the purposes of acceleration of development and the like.

To increase sensitivity, to enhance contrast, and to accelerate developing, the emulsion layer of the light-sensitive material of the invention may incorporate polyalkylene oxide, or an ether-, ester-, or amine-derivative thereof; thioether compound; thiomorpholine; quarternary ammonium compound; urethane derivative; urea derivative; imidazole derivative, and the like.

The photosensitive material may be provided with auziliary layers such as a filter layer, an anti-halation layer and an anti-irradiation layer. These layers and/or emulsion layers may contain a dye that is capable of eluting from the material during a developing process, or that is bleached during a similar process.

The silver halide emulsion layer and/or any other hydrophilic colloid layer may incorporate a matting agent in order to prevent the mutual adhesion of the materials, etc.

The photosensitive material may incorporate an antistatic agent in an antistatic layer that is disposed on one face of the support, i.e. the face not provided with a lamination of the emulsion layers; or, otherwise, an antistatic agent may be incorporated into a protective colloid layer, other than the emulsion layer on a face of the support where a laminated emulsion layers are disposed. The preferred compounds used as an antistatic agent are those described in Article XIII of Research Disclosure No. 17613.

The sensitive material may incorporate any of various surface active agents in its photographic emulsion layer and/or hydrophilic layer in order to improve coatability, slidability, dispersibility of emulsion, to prevent adhesion, to improve photographic characteristics, such as accelerated development, greater sharpness, greater sensitivity and the like, etc.

The examples of a support used in the sensitive material of the invention include a flexible reflective support made of a paper, provided with a lamination of $\alpha$-olefine polymer such as polyethylene, polypropylene, and ethylene/butene copolymer, or a synthesized paper, and the like; a film comprising semisynthesized or synthesized high molecules of, such as, cellulose acetate, cellulose nitrate, polystyrene, polyvinyl chloride, polyethylene terephthalate, polycarbonate, and polyamide; a flexible support made of the above-mentioned film provided with a reflective layer; glass; metal; and ceramics.

The particularly useful coating processes are extrusion coating and curtain coating that are capable of forming two or more layers simultaneously; bucket coating is also applicable depending on a specific requirement. An arbitrary coating velocity can be used.

The invention preferably applies to a color negative film.

A color negative film and color reversal film usually comprise blue-, green-, and red-sensitive silver halide emulsion layer and a non-light-sensitive hydrophilic colloid layer. The invention is not limited by an order according to which these layers are disposed on the support.

To obtain a dye image by using the photosensitive material of this invention, a color photographic process is performed after exposing. A color photographic process comprises of color developing process, bleaching process, fixing process, washing process; and stabilizing process in compliance with a specific requirement. The sensitive material of the invention is capable of being treated in a bleach-fixing process by using monobath bleach-fixer instead of two processes respectively with a bleacher and a fixer. The material is also capable of being treated in a monobath develop-bleach-fixing process by using a monobath develop-bleach-fixer.

Usually, temperatures of processing solutions are within a range of 10° to 65° C., and may exceed 65° C. The preferred temperatures are within a range of 25° to 45° C.

EXAMPLES

The present invention is hereunder described by referring to preferred examples.

Preparation Example 1

Preparation of seed emulsion containing silver halide seed grains

To 500 ml; of 2.0% aqueous gelatin solution heated to 40° C., 250 ml of 4M (molar concentration) aqueous $AgNO_3$ solution and 250 ml of 4M aqueous KBr solution containing $2\times10^{-6}$ mol of $K_3RhCl_6$ were added in 35 minutes according to the method disclosed in Japanese Patent O.P.I. Publication No. 45437/1975, while maintaining the pAg at 9.0 and pH at 2.0 by a controlled double jet process. The above aqueous gelatin solution containing AgX grains, whose silver content is corresponding with the total amount of silver to be incorporated, was adjusted to pH 5.5 by adding aqueous potassium carbonate solution. Then, to the resultant solution were added 364 ml of 5% aqueous solution of Demol N (manufactured by Kao Atlas) as a precipitant, and 244 ml of 20% aqueous magnesium sulfate solution as polyvalent ions solution, to cause coagulation. The coagulation product was precipitated by standing, and the supernatant fraction was decanted. The resultant precipitate, to which 1,400 ml distilled water was added, was further redispersed. The resultant dispersion, to which 36.4 ml of 20% aqueous magnesium sulfate solution was added, was further recoagulated. The recoagulation product was precipitated, and the supernatant fraction was decanted. The resultant precipitate, whose total amount was adjusted to 425 ml using an aqueous solution containing 28 g ossein gelatin, was further dispersed in 40 minutes at 40° C., thus an AgX seed emulsion was prepared.

The above emulsion was designated NE-1. The observation with an electron microscope revealed that NE-1 was a monodispersed emulsion comprising cubic grains whose average grain size was 0.093 μm.

Under the same conditions as in Preparation Example 1, other seed grain emulsions were prepared by varying the type of additive and its amount of addition as specified in Table 1. Observation with an electron microscope revealed that each of NE-2 through NE-9 was a monodispersed emulsion whose average grain size was 0.093 μm. NE-9 was an emulsion containing no additive.

Data of NE-1 are also listed, together with those of NE-2 through NE-8, in Table 1.

TABLE 1

| | Type of additive | Amount added (mol/mol Ag) |
|---|---|---|
| NE-1 | $K_3RhCl_6$ | $2\times10^{-6}$ |
| NE-2 | $K_3RhCl_6$ | $1\times10^{-5}$ |
| NE-3 | $K_3RhCl_6$ | $2\times10^{-5}$ |
| NE-4 | $K_3RhCl_6$ | $2\times10^{-4}$ |
| NE-5 | $K_2IrCl_5$ | $2\times10^{-5}$ |
| NE-6 | $CdCl_2$ | $2\times10^{-5}$ |
| NE-7 | $Pb(NO_3)_2$ | $2\times10^{-5}$ |
| NE-8 | AD-1 | $2\times10^{-4}$ |
| NE-9 | — | — |

Note:
AD-1 (desensitizing dye)

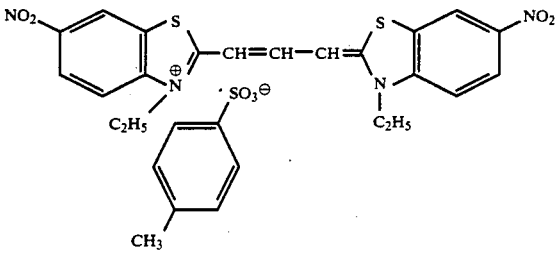

EXAMPLE 1

Each emulsion was prepared as follows:

Based on the seed grain emulsion, obtained in Preparation Example 1, using seven solutions specified below, monodispersed silver iodobromide emulsions Em-1 through Em-9 each comprising core/shell type grains of average grain size of 0.4 μm and average AgI content of 8 mol% were prepared, wherein the AgI content in individual grains varied from the core to outer layers in the sequential order of 15 mol%, 5 mol%, and 3 mol%.

Table 2 specifies these emulsions.

| | |
|---|---|
| (Solution A) | |
| Ossein gelatin | 28.6 g |
| 10% ethanol solution of sodium | |
| $HO(CH_2CH_2O)_m(CH(CH_3)CH_2O)_p(CH_2CH_2O)_nH$ | Mw = 1200–2000 |
| (PRONON, manufactured by Nihon Yushi Co.) | 16.5 ml |
| 4-hydroxy-6-methyl-1,3,3a,7-tetrazaindene (TAI) | 247.5 ml |
| 56% aqueous acetic acid solution | 72.6 ml |
| 28% aqueous ammonia | 97.2 ml |
| Seed emulsion prepared in Preparation Example 1 | 0.134 mol |
| Distilled water to | 6600 ml |
| (Solution B) | |
| Ossein gelatin | 13 g |
| KBr | 460.2 g |
| KI | 113.3 g |
| TAI | 665 mg |
| Distilled water to | 1300 ml |
| (Solution C) | |
| Ossein gelatin | 17 g |
| KBr | 672.6 g |
| KI | 49.39 g |
| TAI | 870 mg |
| Distilled water to | 1700 ml |

-continued

| | |
|---|---|
| (Solution D) | |
| Ossein gelatin | 8 g |
| KBr | 323.2 g |
| KI | 13.94 g |
| TAI | 409 mg |
| Distilled water to | 800 ml |
| (Solution E) | |
| $AgNO_3$ | 1777.2 g |
| 28% aqueous ammonia | 1470 ml |
| Distilled water to | 2989 ml |
| (Solution F) | |
| 20% aqueous KBr solution | amount necessary for controlling pAg |
| (Solution G) | |
| 56% aqueous acetic acid solution | amount necessary for controlling pH |

Using a homogenizer, to solution A were added, at 40° C. solution E and solution B by double jet precipitation process, and, at the completion of adding solution B, addition of solution C was commenced, at the completion of adding solution C, solution D was added. In the course of double jet precipitation, controlling pAg and pH as well as adding velocities of solution E, solution B, solution C, and solution D were as follows.

Controlling pAg and pH was effected by changing the flow rates of solution F and solution G using a roller tube pump of variable flow rate type.

Upon completion of adding solution D and solution E, the pH level was adjusted to 6.0 using solution G. Next, desalination and washing were performed according to a conventional method, thereby the resultant emulsion was dispersed in an aqueous solution containing 197.4 g ossein gelatin.

| Adding rates of solutions | | | | | | | | Change in pH and pAg | | | |
|---|---|---|---|---|---|---|---|---|---|---|---|
| Solution E | | Solution B | | Solution C | | Solution D | | | | | |
| Time (min.) | Rate (ml/min.) | Time (min.) | Rate (ml/min.) | Time (min.) | Rate (ml/min.) | Time (min.) | Rate (ml/min.) | Time (min.) | pH | Time (min.) | pAg |
| 0.0 | 8.4 | 0.0 | 8.0 | 38.5 | 32.2 | 54.8 | 40.9 | 0.0 | 9.00 | 0.0 | 8.55 |
| 2.8 | 12.7 | 2.8 | 12.2 | 39.5 | 32.2 | 56.8 | 43.9 | 4.8 | 8.92 | 30.7 | 8.55 |
| 4.8 | 17.0 | 4.8 | 16.3 | 40.5 | 32.5 | 58.7 | 47.1 | 9.7 | 8.77 | 32.3 | 8.71 |
| 19.0 | 57.2 | 8.7 | 26.7 | 41.5 | 33.0 | 60.5 | 50.5 | 11.5 | 8.70 | 33.9 | 8.88 |
| 21.5 | 58.6 | 16.2 | 48.8 | 42.5 | 33.8 | 61.6 | 52.9 | 13.0 | 8.62 | 35.7 | 9.04 |
| 30.7 | 38.7 | 19.5 | 55.3 | 43.5 | 35.1 | 62.7 | 55.4 | 14.4 | 8.55 | 37.5 | 9.21 |
| 36.6 | 32.1 | 21.0 | 56.6 | 44.5 | 36.9 | 63.7 | 57.9 | 15.6 | 8.47 | 39.5 | 9.37 |
| 41.5 | 29.2 | 22.0 | 55.0 | 45.6 | 39.4 | 64.7 | 60.6 | 17.9 | 8.32 | 41.5 | 9.54 |
| 45.6 | 29.3 | 27.8 | 42.5 | 46.6 | 42.8 | 65.7 | 63.4 | 20.0 | 8.17 | 43.5 | 9.70 |
| 47.5 | 31.0 | 29.9 | 38.3 | 47.5 | 47.7 | 66.6 | 66.3 | 23.1 | 7.95 | 45.6 | 9.87 |
| 49.4 | 35.3 | 31.5 | 37.2 | 48.5 | 54.7 | 67.4 | 69.3 | 25.3 | 7.80 | 46.6 | 9.95 |
| 58.7 | 48.3 | 33.1 | 35.3 | 49.4 | 34.4 | 68.2 | 72.5 | 27.8 | 7.65 | 47.5 | 10.03 |
| 64.2 | 60.8 | 34.8 | 33.8 | 51.8 | 37.1 | 69.0 | 75.8 | 29.2 | 7.57 | 48.5 | 10.11 |
| 70.1 | 83.4 | 36.6 | 32.7 | 53.3 | 39.0 | 70.1 | 81.1 | 30.7 | 7.50 | 49.4 | 10.20 |
| 71.2 | 83.4 | 38.5 | 32.2 | 54.8 | 40.9 | 71.2 | 81.1 | 71.2 | 7.50 | 71.2 | 10.20 |

Then, each of Em-1 through Em-9 was subjected to optimum sensitization with sodium thiosulfate and chlorauric acid as well as sensitizing dyes III and IV. Further, to each emulsion was added a dispersion obtained by simultaneously dispersing 7 mol magenta coupler (M-1) and 0.7 mol colored magenta coupler (CM-1) per mol AgX in di-t-nonyl phthalate, thus each coating solution was prepared.

Onto a subbed cellulose acetate support, each of the above coating solutions was applied so that a coating weight as metal silver was 1.50 g/m$^2$ and a coating gelatin weight was 1.50 g/m$^2$, whereon a yellow filter layer was formed by coating, wherein this layer comprised 0.15 g/m$^2$ yellow colloidal silver; 0.11 g/m$^2$ dibutyl phthalate dispersion having dissolved 0.20 g antistain agent 2,5-di-t-octyl hydroquinone (hereinafter, AS-1); and 1.5 g/m$^2$ gelatin. Thus each sample was prepared.

To each of the above layers was added 30 mg hardener H-1 per gram gelatin.

Each sample obtained was exposed through an optical wedge and treated with the following processes.

| Treatment procedure | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of processing solutions employed in the above processes are as follows.

| | |
|---|---|
| Color developing solution | |
| 4-amino-3-methyl-N-(β-hydroxyethyl)-aniline sulfate | 4.75 g |
| Sodium sulfite anhydride | 4.25 g |
| Hydroxylamine ½.sulfate | 2.0 g |
| Potassium carbonate anhydride | 37.5 g |
| Potassium bromide | 1.3 g |
| Trisodium nitrilotriacetate (monohydrate) | 2.5 g |
| Potassium hydroxide | 1.0 g |
| Water was added to prepare one liter solution. | |
| Bleaching solution | |
| Ferric ammonium ethylenediaminetetraacetate | 100.0 g |
| Diammonium ethylenediaminetetraacetate | 10.0 g |
| Potassium bromide | 150.0 g |
| Glacial acetic acid | 10.0 g |
| Water was added to prepare one liter solution, which was adjusted to pH 6.0 using aqueous ammonia. | |
| Fixing solution | |
| Ammonium thiosulfate | 175.0 g |
| Ammonium sulfite anhydride | 8.6 g |
| Sodium metabisulfite | 2.3 g |
| Water was added to prepare one liter solution, which was adjusted to pH 6.0 using acetic acid. | |
| Stabilizing solution | |
| Formalin (37% aqueous solution) | 1.5 ml |
| Konidax (manufactured by Konica Corporation) | 7.5 ml |
| Water was added to prepare one liter solution. | |

Each sample after processing was subjected to sensitometric evaluation. The sensitivity results are also listed in Table 2.

The listed sensitivities are independently a sensitivity at a point corresponding with a density of fog level plus 0.1 on the characteristic curve, and each sensitivity is a value relative to the sensitivity of Sample No. 109, i.e. 100.

TABLE 2

| Sample No. | Em. No. | Seed grain emulsion used: Seed grain emulsion No., | Seed grain emulsion used: additive | Amount of additive* (mol/molAg) | Relative sensitivity |
|---|---|---|---|---|---|
| 101 | Em-1 | NE-1 | $K_3RhCl_6$ | $2.5 \times 10^{-8}$ | 79 |
| 102 | Em-2 | NE-2 | $K_3RhCl_6$ | $1.25 \times 10^{-7}$ | 53 |
| 103 | Em-3 | NE-3 | $K_3RhCl_6$ | $2.5 \times 10^{-7}$ | 25 |
| 104 | Em-4 | NE-4 | $K_3RhCl_6$ | $2.5 \times 10^{-6}$ | 12 |
| 105 | Em-5 | NE-5 | $K_2IrCl_5$ | $2.5 \times 10^{-7}$ | 42 |
| 106 | Em-6 | NE-6 | $CdCl_2$ | $2.5 \times 10^{-7}$ | 48 |
| 107 | Em-7 | NE-7 | $Pb(NO_3)_2$ | $2.5 \times 10^{-7}$ | 21 |
| 108 | Em-8 | NE-8 | AD - 1 | $2.5 \times 10^{-6}$ | 21 |
| 109 | Em-9 | NE-9 | — | — | 100 |
| 110 | Em-10** | NE-9 | — | $2.5 \times 10^{-7}$** | 15 |

*Amount of additive: amount of additive per mol silver after seed grains having grown to 0.4 μm in size

**Em-10: an emulsion obtained according to the preparation in Example 1 except that $2.5 \times 10^{-7}$ mol (amount per mol Ag of 0.4 μm silver halide grains) $K_3RhCl_6$ was added after three minutes after initiation of adding solution E The results listed in Table 2 show that subjecting emulsions to doping with a metal ion or a desensitizing dye allows the emulsions to have different sensitivities in spite of having a common average grain size.

In addition, the results obtained with Sample Nos. 101 through 104 show that sensitivity of an emulsion can be arbitrarily controlled by varying the doping amount.

EXAMPLE 2

In this example, exposure latitude, stability of coating solution as well as processing stability were evaluated.

Preparation of Sample No. 201 (comparative)

A monodispersed silver halide emulsion Designated Em-11, of an average grain size 0.7 μm, prepared using seed grain emulsion, NE-9 in accordance with the method mentioned in Example 1, as well as Em-9 (average grain size, 0.4 μm; seed grain emulsion, NE-9) were independently subjected to optimum sensitization as in Example 1 to prepare two types of emulsions whose sensitivities differing from each other. A mixture of equivalent amount of the two emulsions was subjected to layer-forming in a manner same as in Example 1 to prepare Sample No. 201.

Preparation of Sample No. 202 (comparative)

Em-9 was divided into two portions, each of which was independently subjected to optimum sensitization with a different amount of sensitizing dye, whereby two types of emulsions of different sensitivities were obtained. A mixture of equivalent amount of the two emulsions was subjected to layer-forming in a manner same as in Example 1 to prepare Sample Mo. 202.

Preparation of Sample No 203 (invention)

Em-9, Em-3 and Em-4 were mixed at a molar ratio of 4:3:3. The resultant mixture was subjected to optimum sensitization in a manner same as in Example 1, and further subjected to layer-forming as in Example 1 to prepare Sample No. 203. Difference in sensitivity of Em-9 and Em 4 is 0.92 in terms of the difference between logarithmic value (logH) of exposures required to provide (fog+0.1) densities.

M-1

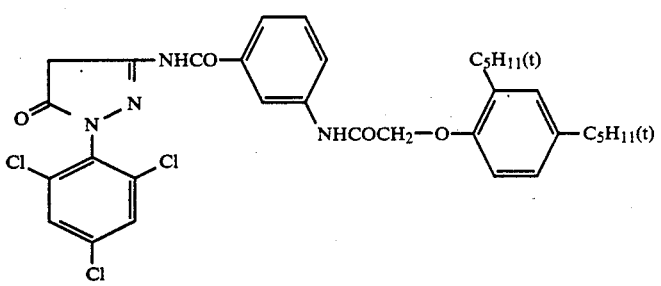

CM-1

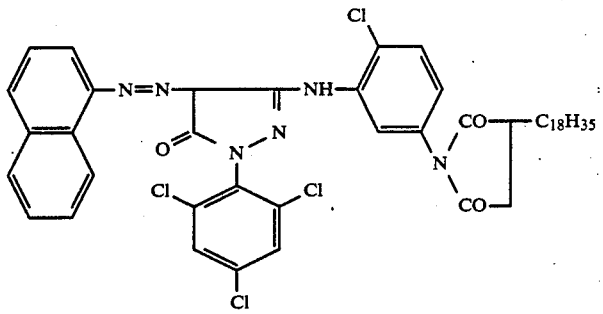

H-1

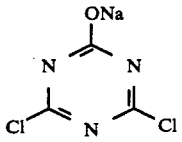

Preparation of Sample No. 204 (invention)

An emulsion containing silver iodo-bromide grains of an average grain size 0.4 μm was prepared (hereinafter referred to as Em-A) in a manner same as in Example 1, except that a blend of NE-9, NE-3 and NE-4 mixed together at a molar ratio of 4:3:3 was used as a seed grain emulsion. The obtained emulsion was subjected to optimum sensitization in a manner same as in Example 1, and further subjected to layer-forming as in Example 1 to prepare Sample No. 204.

Preparation of Sample No. 205

Sample No. 109 prepared in Example 1 was employed as Sample No. 205.

The obtained sample was exposed and processed in a manner same as in Example 1.

Incidentally, based on each sample, two sub-types were prepared for evaluation of stability of a coating solution: with one sub-type, a coating solution being subjected to layer-forming immediately after preparation; with the other sub-type, a coating solution being allowed to stand for 6 hours at 50° C., and then, subjected to coating.

The results are listed in Table 3.

TABLE 3

| Sample No. | Constitution of sample | Exposure latitude | Stability of coating solution* | Processing stability** |
|---|---|---|---|---|
| 201 (Comparative) | Mixture with grains of sizes 0.4 μm and 0.7 μm | 3.2 | 81 | 55 (%) |
| 202 (Comparative) | Mixture of emulsions, of a common grain size 0.4 μm, individual emulsions having a different amount of sensitizing dye | 3.0 | 56 | 74 |
| 203 (Invention) | Mixture of emulsions individually doped with a different amount of $K_3RhCl_6$ | 3.4 | 98 | 88 |
| 204 (Invention) | Emulsion containing grown grains, which has been made from a mixture of seed grain emulsions individually doped with a different amount of $K_3RhCl_6$ | 3.4 | 97 | 89 |
| 205 (Comparative) | Single emulsion of an average grain size 0.4 μm | 2.5 | 98 | 88 |

*Stability of coating solution: Indicated by a sensitivity of a sample obtained by applying a coating solution that was allowed to stand for 6 hours at 50° C., and relative to a sensitivity of 100 of a similar sample that differed from the former in that a coating solution was subjected to coating immediately after its preparation; a smaller value means less stable coating solution.

**Processing stability: Indicated by a sensitivity of a sample developed in 2 min. 45 sec., and relative to a sensitivity 100 of a similar sample developed in 3 min. 15 sec.; a smaller value means poorer processing stability.

The results in Table 3 show that the samples of the invention are endowed with a larger exposure latitude, when comparing Sample No. 205 with Sample Nos. 203 and 204, accordingly, it is apparent that the invention has achieved significant improvement in stability of coating solution as well as in processing stability, both hitherto insufficient with a prior art.

Sample Nos. 203 and 204 of the invention are favorable since chemical sensitization is performed in one batch, thus resulting in simpler manufacturing process, and smaller manufacturing cost. Sample No. 204 is particularly advantageous in that physical ripening, chemical ripening and preparation of an emulsion containing grown grains is performed in one batch, and is more satisfactory for the above manufacturing criteria.

Additionally, the effects of the invention were also attained with a sample prepared in a manner identical with that of Sample No. 203 except that, according to the preparation of Em-10 in Example 1, the mixture emulsion of Sample No. 203 to which two emulsions were further added was used; one emulsion to which $K_3RhCl_6$ was added at a rate of $1\times10^{-11}$ mol per mol silver and the other to which similar material was added at a rate of $1\times10^{-2}$ mol per mol silver (that is, the resultant emulsion was a mixture of five emulsions of equivalent molar amount).

Also, the effects of the invention were attained with a sample prepared in a manner indentical with that of the sample mentioned above except that Em-4 was excluded.

EXAMPLE 3

Onto a subbed cellulose acetate support, photographic structural layers having the following compositions were formed sequentially, thus a multi-layered color photographic light-sensitive material No. 301 was prepared.

The coating weights applicable are defined as follows a coating weight of silver halide or colloidal silver is a value of a silver-converted weight indicated in g/m$^2$ unit; a coating weight of an additive or gelatin is a value indicated in g/m$^2$ unit; a coating weight of a sensitizing dye or coupler is a value indicated by a molar quantity per mol silver halide in the photographic structural layer.

The silver halide emulsions contained in the light-sensitive emulsion layers were individually subjected to optimum sensitization in a manner same as in Example 1.

| Layer | Principal components | Amount |
|---|---|---|
| 1st layer (HC) (anti-halation layer) | Black colloidal silver | 0.20 |
| | Gelatin | 1.5 |
| | Ultraviolet absorbent UV-1 | 0.1 |
| | Ultraviolet absorbent UV-2 | 0.2 |
| | Dioctyl phthalate (hereinafter, DOP) | 0.03 |
| 2nd layer (IL-1) (Intermediate layer) | Gelatin | 2.0 |
| | AS-1 | 0.1 |
| | DOP | 0.1 |
| 3rd layer (R-1) (1st red-sensitive emulsion layer) | Em-9 | 1.2 |
| | Gelatin | 1.1 |
| | Sensitizing dye I | $6 \times 10^{-5}$ |
| | Sensitizing dye II | $1 \times 10^{-5}$ |
| | Coupler (C-1) | 0.06 |
| | Coupler (CC-1) | 0.003 |
| | DIR Compound (D-1) | 0.0015 |
| | DIR Compound (D-2) | 0.002 |
| | DOP | 0.6 |
| 4th layer (R-2) (2nd red-sensitive emulsion layer) | Em-11 | 1.0 |
| | Gelatin | 1.1 |
| | Sensitizing dye I | $3 \times 10^{-5}$ |
| | Sensitizing dye II | $1 \times 10^{-5}$ |
| | Coupler (C-1) | 0.03 |
| | D-2 | 0.001 |
| 5th layer (IL-2) (Intermediate layer) | Gelatin | 0.8 |
| | AS-1 | 0.03 |
| | DOP | 0.1 |
| 6th layer (G-1) (1st green-sensitive emulsion layer) | Em-9 | 1.1 |
| | Gelatin | 1.2 |
| | Sensitizing dye III | $2.5 \times 10^{-5}$ |
| | Sensitizing dye IV | $1.2 \times 10^{-5}$ |
| | Coupler (M-2) | 0.045 |
| | Coupler (CM-1) | 0.009 |
| | D-1 | 0.001 |
| | DIR Compound (D-3) | 0.003 |
| | Tricresyl phosphate (hereinafter, TCP) | 0.5 |

-continued

| Layer | Principal components | Amount |
|---|---|---|
| 7th layer (G-2) (2nd green-sensitive emulsion layer) | Em-11 | 1.3 |
| | Gelatin | 0.8 |
| | Sensitizing dye III | $1.5 \times 10^{-5}$ |
| | Sensitizing dye IV | $1.0 \times 10^{-5}$ |
| | Coupler (M-1) | 0.03 |
| | D-3 | 0.001 |
| | TCP | 0.3 |
| 8th layer (YC) (Yellow filter layer) | Gelatin | 0.6 |
| | Yellow colloidal silver | 0.08 |
| | AS-1 | 0.1 |
| | DOP | 0.3 |
| 9th layer (B-1) (1st blue-sensitive emulsion layer) | Em-9 | 0.5 |
| | Gelatin | 1.1 |
| | Sensitizing dye V | $1.3 \times 10^{-5}$ |
| | Coupler (Y-1) | 0.29 |
| | TCP | 0.2 |
| 10th layer (B-2) (2nd blue-sensitive emulsion layer) | Em-11 | 0.7 |
| | Gelatin | 1.2 |
| | Sensitizing dye V | $1 \times 10^{-5}$ |
| | Coupler (Y-1) | 0.08 |
| | D-2 | 0.0015 |
| | TCP | 0.1 |
| 11th layer (Pro-1) (1st protective layer) | Gelatin | 0.55 |
| | Ultraviolet absorbent UV-1 | 0.1 |
| | Ultraviolet absorbent UV-2 | 0.2 |
| | DOP | 0.03 |
| | Silver iodo-bromide (AgI, 1 mol %; average grain size, 0.07 μm) | 0.5 |
| 12th layer (Pro-2) (2nd protective layer) | Gelatin | 0.5 |
| | Polymethyl methacrylate particles (dia.; 1.5 μm) | 0.2 |
| | Formalin scavenger (HS-1) | 3.0 |
| | Hardener (H-1) | 0.4 |

To each layer was added a surface-active agent as a coating aid, in addition to the above components.

D-2

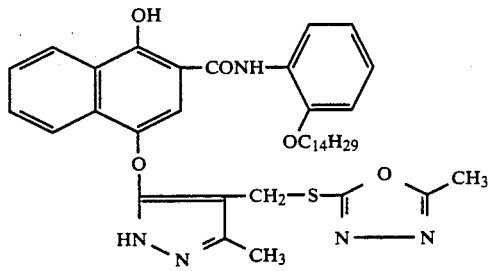

D-3

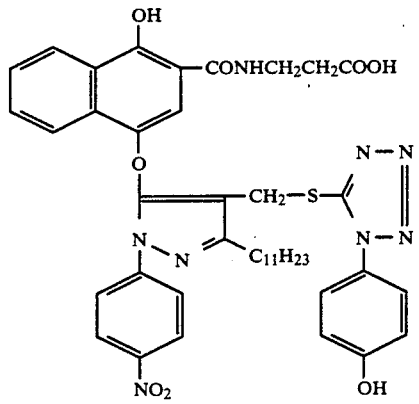

M-2

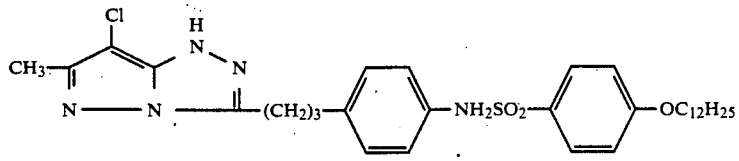

-continued
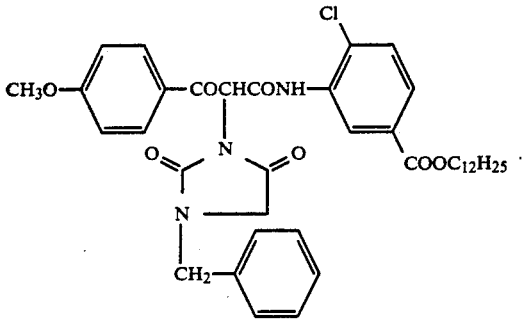
Y-1
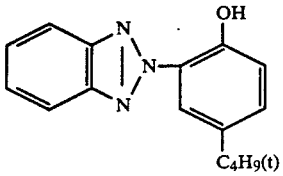
UV-1
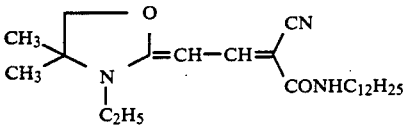
UV-2
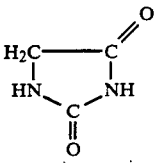
HS-1
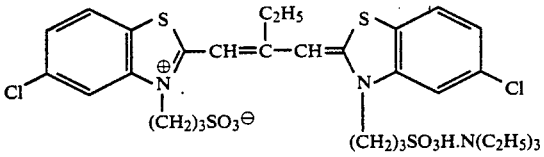
Sensitizing dye I
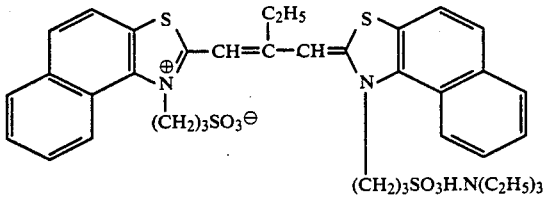
Sensitizing dye II
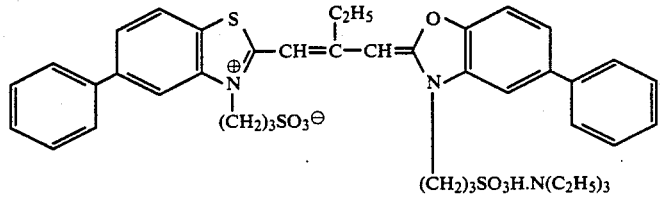
Sensitizing dye III
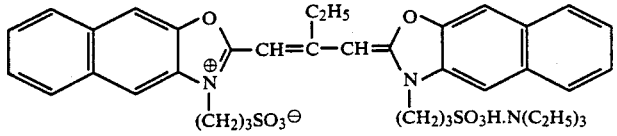
Sensitizing dye IV -continued Sensitizing dye V

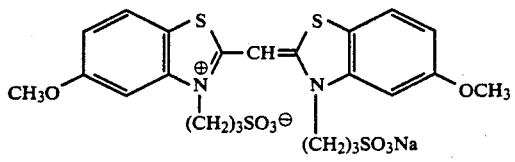

C-1

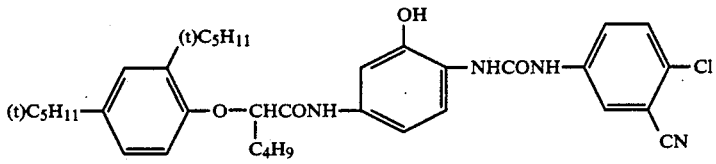

CC-1

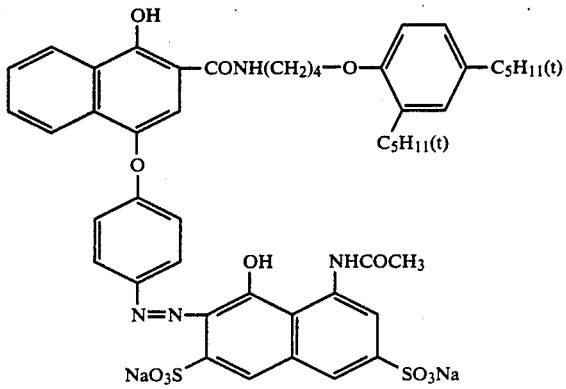

D-1

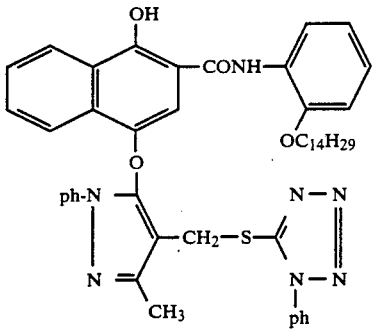

The layers having the above compositions are hereunder abbreviated correspondingly to HC, IL-1, R-1, R-2, IL-2, G-1, G-2, YC, B-1, B-2, Pro-1, and Pro-2, as specified above.

Preparation of Sample No. 302 (comparative)

This sample was constituted as follows.

Each emulsion was subjected to optimum sensitization in a manner same as for Sample No. 301.

1st layer HC, same as the 1st layer of Sample No. 301

2nd layer IL-1, same as the 2nd layer of Sample No. 301

3rd layer R-1, same as the 3rd layer of Sample No. 301, except that a rate of Em-9 used was 1.5 g/m$^2$; a rate of gelatin, 1.4 g/m$^2$; and a rate of DOP, 0.75 g/m$^2$.

4th layer IL-2, same as the 5th layer of Sample No. 301,

5th layer G-1, same as the 6th layer of Sample No. 301, except that a rate of Em-9 used was 1.4 g/m$^2$; a rate of gelatin, 1.5 g/m$^2$; and a rate of TCP, 0.6 g/m$^2$.

6th layer YC, same as the 8th layer of Sample No. 301.

7th layer B-1, same as the 9th layer of Sample No. 301, except that a rate of Em-9 used was 0.63 g/m$^2$; a rate of gelatin, 1.4 g/m$^2$; and a rate of TCP, 0.25 g/m$^2$.

8th layer Pro-1, same as the 11th layer of Sample No. 301.

9th layer Pro-2, same as the 12th layer of Sample No. 301.

In this sample, the emulsion layers corresponding to the layers of R-2, G-2 and B-2 of Sample 301 were not included.

Preparation of Sample No. 303 (invention)

Instead of Em-9 in the third, fifth and seventh layers of Sample No. 302, a blend of Em-9, Em-3 and Em-4 each undergone optimum sensitization, and mixed at a molar ratio of 4:3:3 was employed. Except that, the same steps as for Sample No. 302 were exercised to prepare Sample No. 303.

Preparation of Sample No. 304 (invention)

Instead of Em-9 in the third, fifth and seventh layers of Sample No. 302, a blend of Em-9, Em-3 and Em-4 mixed at a molar ratio of 4:3:3, thereby the blend was subjected to optimum sensitization, was employed. Except that, the same steps as for Sample No. 302 were exercised to prepare Sample No. 304.

Preparation of Sample No. 305 (invention)

Instead of Em-9 in the third, fifth and seventh layers of Sample No. 302, Em-A was employed. Except that, the same steps as for Sample No. 302 were exercised to prepare Sample No. 305.

The so-obtained Sample Nos. 301 through 305 were, as in Example 1, exposed through an optical wedge, and subjected to processing.

Each sample thus processed was evaluated for exposure latitude, sharpness (MTF) and graininess (RMS). The results are listed in Table 4.

Sharpness is evaluated based on MTF (Modulation Transfer Function) of a dye image at a spatial frequency of 10 lines/mm, and each value is a value relative to that of Sample No. 301, i.e. 100. Graininess is evaluated by multiplying 1000 times standard deviations in fluctuation in density level occurring when scanning a dye image having a minimum density +1.2 with a microdensitometer of a circular scanning aperture of 25 μm.

TABLE 4

| | Properties | | | | | | | | |
|---|---|---|---|---|---|---|---|---|---|
| | Latitude | | | Sharpness | | | Graininess | | |
| Sample No. | B*1 | G*2 | R*3 | B*1 | G*2 | R*3 | B*1 | G*2 | R*3 |
| 301 (Comparative) | 3.5 | 3.4 | 3.4 | 100 | 100 | 100 | 32 | 31 | 30 |
| 302 (Comparative) | 2.9 | 2.8 | 2.8 | 145 | 168 | 178 | 14 | 14 | 13 |
| 303 (Invention) | 3.8 | 3.8 | 3.7 | 143 | 172 | 180 | 13 | 14 | 12 |
| 304 (Invention) | 3.8 | 3.8 | 3.7 | 144 | 173 | 181 | 14 | 13 | 13 |
| 305 (Invention) | 3.7 | 3.8 | 3.7 | 144 | 171 | 181 | 14 | 14 | 13 |

B*1 Blue-sensitive emulsion layer
G*2 Green-sensitive emulsion layer
R*3 Red-sensitive emulsion layer Comparing the data of Sample No. 302 in Table 4 with the data of Sample Nos. 303 to 305reveals that it is possible to enlarge exposure latitude by combinedly incorporating different groups of silver halide grains, wherein the respective groups are of different sensitivities in spite of an average grain size common to both.

The comparison of Sample No 301 with Sample No. 302 reveals that changing constitution of each color-sensitive layer from the two-layer constitution (Sample No. 301) to the single-layer constitution (Sample No. 302) greatly limits exposure latitude at a cost of significantly improved sharpness and graininess.

In contrast, Sample Nos. 303 through 305 of the invention, though individually having color-sensitive layers of which constitution identical with that of Sample No. 302, exhibit greatly improved sharpness and graininess, and exposure latitude of these samples are comparable to or more than that of Sample No. 301 and deemed satisfactory.

Sample Nos. 303 through 305 allow the reduction both in number of photographic structural layers, and in number of steps for emulsion preparation, thus simplifying manufacturing process, and reducing a manufacturing cost.

Preparation Example 2

Preparation of seed emulsion

A seed emulsion was prepared in a manner identical with that of the seed emulsion in Preparation Example 1 except that $2\times10^{-6}$ mol $K_3RhCl_6$ alone was added to 500 ml 2.0% aqueous gelatin solution warmed to 40° C., and that $K_3RhCl_6$ in 4M KBr solution was eliminated.

This emulsion was designated NE-11. The observation with an electron microscope revealed that NE-11 was a monodispersed emulsion comprising cubic grains whose average grain size was 0.093 μm.

Under the same conditions as in Preparation Example 1, other seed emulsions were prepared by varying the type of additive and its amount of addition as specified in Table 5. Observation with an electron microscope revealed that each of NE-12 through NE-19 was a monodispersed emulsion comprising cubic grains whose average grain size was 0.093 μm.

Data of NE-11 are also listed, together with those of NE-12 through NE-19, in Table 5.

TABLE 5

| Seed emulsion No. | Type of additive | Amount added (mol/molAg) |
|---|---|---|
| NE-11 | $K_3RhCl_6$ | $2\times10^{-6}$ |
| NE-12 | $K_3RhCl_6$ | $1\times10^{-5}$ |
| NE-13 | $K_3RhCl_6$ | $2\times10^{-5}$ |
| NE-14 | $K_3RhCl_6$ | $2\times10^{-4}$ |
| NE-15 | $K_2IrCl_5$ | $2\times10^{-4}$ |
| NE-16 | $CdCl_2$ | $2\times10^{-4}$ |
| NE-17 | $Pb(NO_3)_2$ | $2\times10^{-4}$ |
| NE-18 | AD - 1 | $2\times10^{-4}$ |
| NE-19 | — | — |

Preparation of Example Emulsion

Based on the seen grain emulsion preparation in Example 1, monodispersed emulsions Em-11 through Em-19 were prepared using seed emulsions specified in Table 5. The respective emulsions comprised silver iodide grains, individual grains of which having a greater AgI content rate at the core, wherein the average AgI content being 8 mol%.

Table 6 lists the resultant data and contents of each emulsion. Em-11 was identical with Em-11 prepared in Example 2.

TABLE 6

| Emulsion No. | Contents of emulsions: Average grain size (μm) | Variation coefficient | Contents of seed emulsion: Seed emulsion No. | Additive | Amount of additive* (mol/molAg) |
|---|---|---|---|---|---|
| Em-11 | 0.7 | 0.19 | NE-19 | — | — |
| Em-12 | 0.7 | 0.19 | NE-14 | $K_3RhCl_6$ | $4.7 \times 10^{-7}$ |
| Em-13 | 0.5 | 0.18 | NE-13 | $K_3RhCl_6$ | $1.3 \times 10^{-7}$ |
| Em-14 | 0.35 | 0.20 | NE-19 | — | — |
| Em-15 | 0.35 | 0.20 | NE-12 | $K_3RhCl_6$ | $1.9 \times 10^{-7}$ |
| Em-16 | 0.35 | 0.20 | NE-14 | $K_3RhCl_6$ | $3.8 \times 10^{-6}$ |
| Em-17 | 0.35 | 0.20 | NE-15 | $K_2IrCl_5$ | $3.8 \times 10^{-6}$ |
| Em-18 | 0.35 | 0.20 | NE-18 | AD - 1 | $3.8 \times 10^{-6}$ |
| Em-19 | 0.20 | 0.20 | NE-19 | — | — |

*Amount of additive: amount per mol silver in example emulsion

EXAMPLE 4

Using the so-obtained emulsions, Sample Nos. 401 through 403 were prepared respectively by applying a mixture comprising two types of emulsions. Each mixture molar ratio of emulsion was 1:1, while the other preparation conditions were identical with those of Example 1.

The so-prepared samples were subjected, as in Example 1, to exposing, and processing, and exposure latitude and processing stability were evaluated.

Definition and evaluation data of each sample is listed in Table 7.

TABLE 7

| Sample No. | Emulsion used: Em. No. | Variation coefficient*2 | Sensitivity characteristics: Size ratio | Exposure latitude | Processing stability*1 |
|---|---|---|---|---|---|
| 401 (Comparative) | Em-11 and Em-19 | 0.60 | 0.29 | 3.7 | 100 |
| 402 (Comparative) | Em-11 and Em-14 | 0.39 | 0.5 | 3.2 | 57 |
| 403 (Inventive) | Em-11 and Em-15 | 0.39 | 0.5 | 3.7 | 55 |

*1Processing stability: indicated as a relative value based on the sensitivity variation of 100, that was determined by comparing the sensitivity of Sample No. 402 developing with a developer of pH 10.02 with the sensitivity of the same sample developed with a developer of pH 9.8. A smaller value means that a sample is stabler relative to variation in processing conditions (hereunder applicable).
*2Variation coefficient: variation coefficient of size distribution of a mixture emulsion.

As can be understood from the data of Sample Nos. 401 and 402, varying an average grain size of an emulsion to widen exposure latitude results in loss in stability relative to variation in processing conditions, improving such stability results in failure of attaining sufficient exposure latitude.

Exposure latitude and processing stability are two conflicting criteria.

In contrast, with Sample No. 403 of the invention, the grain size ratio between an emulsion of higher speed (Em-11) and an emulsion of lower speed (Em-15) is larger than Sample No. 401, and, accordingly, compared with Sample No. 401, this sample apparently excels in stability relative to variation in processing condition, while this sample satisfies exposure latitude like Sample No. 401. To sum up, it was confirmed that according to the invention, wider latitude as well as stable photographic performance relative to variation in processing condition are attained.

EXAMPLE 5

Onto a subbed cellulose acetate support, photographic structural layers having the following compositions were formed sequentially, thus a multi-layered color photographic light-sensitive material No. 501 was prepared.

The coating weights applicable are defined as follows: a coating weight of silver halide or colloidal silver is a value of a silver-converted weight indicated in $g/m^2$ unit; a coating weight of an additive or gelatin is a value indicated in $g/m^2$ unit; a coating weight of a sensitizing dye or coupler is a value indicated by a molar quantity per mol silver halide in a photographic structural layer.

The emulsions contained in the light-sensitive emulsion layers was individually subjected to optimum sensitization.

| Layer | Principal components | Amount |
|---|---|---|
| 1st layer (HC) (anti-halation layer) | Black colloidal silver | 0.20 |
| | Gelatin | 1.5 |
| | Ultraviolet absorbent UV-1 | 0.1 |
| | Ultraviolet absorbent UV-2 | 0.2 |
| | DOP | 0.03 |
| 2nd layer (IL-1) (Intermediate layer) | Gelatin | 2.0 |
| | AS-1 | 0.1 |
| | DOP | 0.1 |
| 3rd layer (R-1) (1st red-sensitive emulsion layer) | Em-14 | 1.2 |
| | Gelatin | 1.1 |
| | Sensitizing dye I | $6 \times 10^{-5}$ |
| | Sensitizing dye II | $1 \times 10^{-5}$ |
| | Coupler (C-1) | 0.08 |
| | Coupler (CC-1) | 0.005 |
| | D-1 | 0.003 |
| | D-2 | 0.004 |
| | DOP | 0.6 |
| 4th layer (R-2) (2nd red-sensitive emulsion layer) | Em-11 | 1.0 |
| | Gelatin | 1.1 |
| | Sensitizing dye I | $3 \times 10^{-5}$ |
| | Sensitizing dye II | $1 \times 10^{-5}$ |
| | Coupler (C-1) | 0.02 |
| | Coupler (CC-1) | 0.0015 |
| | D-2 | 0.001 |
| | DOP | 0.3 |

-continued

| Layer | Principal components | Amount |
|---|---|---|
| 5th layer (IL-2) (Intermediate layer) | Gelatin | 0.8 |
| | AS-1 | 0.03 |
| | DOP | 0.1 |
| 6th layer (G-1) (green-sensitive emulsion layer) | Em-11 and Em-14 (mixture of equivalent molar amount) | 1.1 |
| | Gelatin | 1.2 |
| | Sensitizing dye III | $2.5 \times 10^{-5}$ |
| | Sensitizing dye IV | $1.2 \times 10^{-5}$ |
| | Coupler (M-2) | 0.08 |
| | Coupler (CM-1) | 0.015 |
| | D-1 | 0.001 |
| | D-3 | 0.002 |
| | Tricresyl phosphate (hereinafter, TCP) | 0.5 |
| 7th layer (YC) (Yellow filter layer) (emulsion layer) | Gelatin | 0.6 |
| | Yellow colloidal silver | 0.08 |
| | AS-1 | 0.1 |
| | DOP | 0.3 |
| 8th layer (B-1) (blue-sensitive emulsion layer) | Em-11 and Em-14 (mixture of equivalent molar amount) | 0.5 |
| | Gelatin | 1.1 |
| | Sensitizing dye V | $1.3 \times 10^{-5}$ |
| | Coupler (Y-1) | 0.29 |
| | TCP | 0.2 |
| 9th layer (Pro-1) (1st protective layer) | Gelatin | 0.55 |
| | Ultraviolet absorbent UV-1 | 0.1 |
| | Ultraviolet absorbent UV-2 | 0.2 |
| | DOP | 0.03 |
| | Silver iodo-bromide (AgI, 1 mol %; average grain size, 0.07 μm) | 0.2 |
| 10th layer (Pro-1) (2nd protective layer) | Gelatin | 0.5 |
| | Polymethyl methacrylate particles (dia.; 1.5 μm) | 0.2 |
| | HS-1 | 3.0 |
| | H-1 | 0.4 |

To each layer was added a surface-active agent as a coating aid, in addition to the above components.

Preparation of Sample Nos. 502 through 505

Samples Nos. 502 through 505 were prepared in a manner identical with that of Sample No. 501 except that emulsions in G-1 and B-1 layers of Sample No. 501 were respectively replaced with those specified in Table 8. The so-obtained samples were subjected to wedge exposing according to a conventional method, thereby treated in a manner identical in Example 1. Exposure latitude, processing stability and standing property of coating solution about the green-sensitive AgX emulsion layer of each sample wee evaluated.

TABLE 8

| | Data of emulsion used | | | Photographic characteristics | | |
|---|---|---|---|---|---|---|
| Sample No. | Em. No. | Variation coefficient | Size ratio | Exposure latitude | Processing stability | Standing property of coating solution*1 |
| 501 (Comparative) | Em-11 and Em-14 | 0.39 | 0.5 | 3.4 | 100 | 100 |
| 502 (Inventive) | Em-11 and Em-15 | 0.39 | 0.5 | 4.1 | 100 | 99 |
| 503 (Inventive) | Em-11 and Em-13 | 0.25 | 0.71 | 3.8 | ·72 | 82 |
| 504 (Inventive) | Em-11 and Em-12 | 0.19 | 1.0 | 3.8 | 51 | 60 |
| 505 (Inventive) | *2 | 0.19 | 1.0 | 3.8 | 48 | 59 |

*1Shelf-life of coating solution: The value is relative to 100% deviation in sensitivity that was determined by comparing the sensitivity of Sample No. 501 prepared by using a coating solution immediately after preparation thereof to that of the similar sample prepared by using the coating solution allowed to stand at 50° C. for six hours. A smaller value means better standing property of a coating solution (hereunder applicable).

*2Seed emulsions NE-19 and NE-14 were mixed at a molar ratio of 1:1, thereby grains were grown in a manner same as in Preparation Example 2 to prepare an emulsion of grain size 0.7 μm, and then, the emulsion underwent sensitization in a manner same as in Example 1.

As can be understood from the results in Table 8, the samples of the invention have wider latitude.

Sample 502 having not only a grain size ratio farther from 1.0 but also a desensitizing agent is particularly advantageous because of exposure latitude.

Comparing the samples of the invention with each other revealed that a sample having not only a smaller grain size variation coefficient but also a grain size ratio nearer to 1.0 is advantageous because of better processing stability.

The emulsions for Sample No. 504 can undergo chemical ripening in a single batch, while the emulsions of Sample No. 505 can undergo physical ripening, that is a process including both grain growth, and chemical ripening, in a single batch, thereby both samples allow simpler manufacturing process, and are advantageous because of higher production efficiency.

Like the results of the green-sensitive layers in Table 8, the blue-sensitive layers also exhibited the effects of the present invention.

EXAMPLE 6

In a manner identical with that of Example 5, onto a subbed cellulose acetate support, photographic structural layers having the following compositions were formed sequentially, thus a multi-layered color photographic light-sensitive material No. 601 was prepared.

In this example, exposure latitude and processing stability, and sharpness of resultant images were evaluated with multi-layered photosensitive materials.

The emulsions contained in the light-sensitive emulsion layers was individually subjected to optimum sensitization in a manner identical with that of Example 1.

| Layer | Principal components | Amount |
|---|---|---|
| 1st layer (HC) | Same as in HC layer of Sample No. 501 | |
| 2nd layer (IL-1) | Same as in IL-1 layer of Sample No. 501 | |
| 3rd layer (R-1) | Same as in R-1 layer of Sample No. 501 | |
| 4th layer (R-2) | Same as in R-2 layer of Sample No. 501 | |
| 5th layer (IL-2) | Same as in IL-2 layer of Sample No. 501 | |

-continued

| Layer | Principal components | Amount |
|---|---|---|
| 6th layer (G-1) | Same as in G-1 layer of Sample No. 501 except that the emulsion used was Em-14 only | |
| 7th layer (G-2) | Em-11 | 1.3 |
| | Gelatin | 0.8 |
| | Sensitizing dye III | $1.5 \times 10^{-5}$ |
| | Sensitizing dye IV | $1.0 \times 10^{-5}$ |
| | Coupler (M-1) | 0:03 |
| | D-3 | 0.001 |
| | TCP | 0.3 |
| 9th layer (B-1) | Same as in B-1 layer of Sample No. 501 except that the emulsion used was Em-14 only | |
| 10th layer (B-2) | Em-11 | 0.7 |
| | Gelatin | 1.2 |
| | Sensitizing dye V | $1 \times 10^{-5}$ |
| | Coupler (Y-1) | 0.08 |
| | D-2 | 0.0015 |
| | TCP | 0.1 |
| 11th layer (Pro-1) | Same as in Pro-1 of Sample No. 501 | |
| 12th layer (Pro-2) | Same as in Pro-2 of Sample No. 501 | |

To each layer was added a surface-active agent as a coating assistant, in addition to the above components.

Preparation of Sample Nos. 602 through 605

These samples were prepared in a manner identical with that of Sample No. 601 except that emulsions in R-1, G-1, and B-1 were replaced as specified in Table 9 and layers R-2, G-2, and B-2 were excluded.

The so-prepared samples were subjected, as in Example 1, to exposing and developing, and then, the green-sensitive emulsion layers were subjected to sensitometric evaluation. The results are also listed in Table 9.

TABLE 9

| | Data of emulsion used | | | Sensitometric data | | |
|---|---|---|---|---|---|---|
| Sample No. | Emulsion No. | Variation coefficient | Size ratio | Exposure latitude | Processing stability | Sharpness |
| 601 (Comparative) | Em-11*1 and Em-14*1 | 0.19<br>0.20 | —<br>— | 3.6 | 100 | 31 |
| 602 (Comparative) | Em-14 | 0.20 | — | 2.5 | 48 | 13 |
| 603 (Inventive) | Em-14 and Em-16*2 | 0.20 | 1.0 | 3.7 | 47 | 12 |
| 604 (Inventive) | Em-14 and Em-17*2 | 0.20 | 1.0 | 3.7 | 48 | 12 |
| 605 (Inventive) | Em-14 and Em-18*2 | 0.20 | 1.0 | 3.6 | 49 | 12 |

*1Em-11 and Em-14 each is used in a separated layer.
*2mixture molar ratio of emulsions in Sample Nos. 603 through 605 was 1:1.

Comparing Sample No. 601 with Sample No. 602 revealed that changing two-layer constitution (Sample No. 601) into single layer constitution as specified above (Sample No. 602) significantly improves sharpness, and processing stability. However, the resultant exposure latitude is significantly smaller.

In contrast, though the layer constitution is same as that of sample No. 602, Sample, Nos. 603 through 605 according to the invention exhibit remarkable improvement both in sharpness and processing stability, while their exposure latitude is comparable to that of Sample No. 601 and is satisfacotory.

Additionally, the effects of the invention were also attained with a sample (Sample B) prepared in a manner identical with that of Sample No. 603 except that another mixture emulsion was additionally used, wherein this additional mixture emulsion comprised two seed emulsions respectively containing 0.35 μm grains grown based on Preparation Example in Example 1 (these emulsions contained $K_3RhCl_6$ respectively at a rate of $1\times10^{-9}$ mol and at a rate of $1\times10^{-4}$ mol per mol of 0.35 μm silver halide grains), wherein based on Seed Preparation Example 1, the former seed emulsion was prepared by adding $K_3RhCl_6$ at a rate of $5.3\times10^{-8}$ mol, and the latter seed emulsion was prepared by adding $K_3RhCl_6$ at a rate of $5.3\times10^{-3}$ mol (the finally prepared mixture emulsion comprised four emulsions of equivalent molar amount).

Also, the effects of the invention were attained with samples prepared in a manner identical with that of sample B mentioned above except that Em-14 was excluded and except that emulsion containing $K_3RhCl_6$ at a rate of $1\times10^{-4}$ mol per mol AgX.

What is claimed is:

1. A process for manufacturing a silver halide emulsion comprising at least two groups of silver halide grains which are substantially different in desensitizing agent content from each other, comprising the steps of:
   (a) mixing at least two groups of silver halide seed grains, wherein said groups of silver halide seed grains are different from each other in the content of a desensitizing agent contained therein, and then
   (b) growing said mixed silver halide seed grains so as to make said silver halide emulsion comprising said at least two groups of silver halide grains.

2. The process of claim 1, wherein the desensitizing agent content of the group of silver halide grains having the lowest desensitizing agent content is zero.

3. The process of claim 1, wherein the desensitizing agent content of the group of silver halide grains having highest desensitizing agent content is not less than 10 times higher than that of the group of silver halide grains having the lowest desensitizing agent content.

4. The process of claim 3, wherein the desensitizing agent content of the group of silver halide grains having highest desensitizing agent content is not less than $10^3$ times higher than that of the group of silver halide grains having the lowest desensitizing agent content.

5. The process of claim 1, wherein said desensitizing agent is a metal ion.

6. The process of claim 5, wherein said metal ion is contained in said silver halide grains in a content of from $10^{-17}$ mol to $10^{-2}$ mol per mol of silver halide.

7. The process of claim 5, wherein said desensitizing agent is selected from the group consisting of ions of iridium, cadmium, lead, rhodium, zinc, iron, thalium, bismuth, gold, osmium and paladium.

8. The process of claim 7, wherein said desensitizing agent is rhodium ion.

9. The process of claim 8, wherein said rhodium ion is contained in said silver halide grains in a content of from $10^{-14}$ mol to $10^{-2}$ mol per mol of silver halide.

* * * * *